US008721226B2

(12) United States Patent
Baumsteiger

(10) Patent No.: US 8,721,226 B2
(45) Date of Patent: May 13, 2014

(54) HELICAL ROCK TIP

(75) Inventor: Christian R. Baumsteiger, Woodacre, CA (US)

(73) Assignee: Christian R. Baumsteiger, Woodacre, CA (US)

( * ) Notice: Subject to any disclaimer, the term of this patent is extended or adjusted under 35 U.S.C. 154(b) by 0 days.

(21) Appl. No.: 13/399,914

(22) Filed: Feb. 17, 2012

(65) Prior Publication Data

US 2012/0213597 A1 Aug. 23, 2012

Related U.S. Application Data

(60) Provisional application No. 61/444,671, filed on Feb. 18, 2011.

(51) Int. Cl.
*E02D 5/54* (2006.01)

(52) U.S. Cl.
USPC ..... 405/253; 405/252.1; 52/157

(58) Field of Classification Search
USPC ..... 405/253, 254, 252.1, 231, 230, 259.1; 52/157
See application file for complete search history.

(56) References Cited

U.S. PATENT DOCUMENTS 3,688,014 A * 8/1972 Versteeg ..... 405/253
4,290,245 A * 9/1981 Pardue et al. ..... 52/157
5,408,788 A * 4/1995 Hamilton et al. ..... 405/253
5,575,122 A * 11/1996 Hamilton et al. ..... 405/253
6,615,554 B2 * 9/2003 Rupiper ..... 405/252.1
6,702,239 B2 * 3/2004 Boucher ..... 52/157
6,817,810 B2 * 11/2004 Jones ..... 405/252.1
7,018,139 B1 * 3/2006 Slemons ..... 405/253
7,037,045 B2 * 5/2006 Jones ..... 405/252.1
7,112,012 B2 * 9/2006 Whitsett ..... 405/253
7,241,079 B2 * 7/2007 Francis ..... 405/231
2004/0076479 A1 * 4/2004 Camilleri ..... 405/252.1

* cited by examiner

*Primary Examiner* — Frederick L Lagman

(74) *Attorney, Agent, or Firm* — Kilpatrick Townsend & Stockton LLP

(57) ABSTRACT

A helical pier having a rock tip for rotational insertion into soil/rock and anchoring a structure thereto has an elongated shaft with a longitudinal axis, a penetrating end, a trailing end, and a peripheral surface between the penetrating end towards the trailing end. The penetrating end defines a penetrating edge of the shaft. A recess formed in the shaft extends from the first end surface toward the trailing end of the shaft, forms a recess wall and terminates in a second end surface that is obliquely inclined relative to the first end surface and the longitudinal axis. The recess wall defines a lateral cutting edge oriented transversely to the penetrating edge. In use, the recess receives soil/rock loosened by the penetrating edge and the cutting edge, and the second end surface directs loosened soil/rock out of the recess when the helical pier is rotated into the soil/rock.

15 Claims, 4 Drawing Sheets

--PRIOR ART--

HELICAL ROCK TIP

CROSS-REFERENCES TO RELATED APPLICATION

This application claims the benefit of U.S. Provisional Patent Application No. 61/444,671, filed Feb. 18, 2011, the disclosure of which is incorporated by reference.

BACKGROUND OF THE INVENTION

Generally speaking, there are a variety of helical piers available on the market. Helical piers have a slender shaft with a helically shaped plate attached to it. When the shaft is rotated, the plate spirals into the soil, thus pulling the pier deeper down. Helical piers are often used to pull shaft-like extensions into the soil. Extensions are usually elongated, relatively slender bars which are attached to the shaft of the helical pier or to another extension. Together, helical piers and extensions form an in-ground load-bearing anchor or structure. If the in-ground structure needs to be positioned deep into the soil, multiple extensions may be connected in succession, the first one being attached to the trailing end of the helical pier's shaft, and each subsequent extension being attached to the trailing end of the preceding extension. The in-ground structure has a very high load-bearing capacity. Once inserted into the soil, helical piers remain there permanently; i.e. they are not designed to be pulled out and reused. Conventional helical piers and extensions can be obtained, for example, as Square-Shaft Helical-Piers marketed by the A.B. Chance Company of Centralia, Mo.

When the rotation of the helical pier stops, it and the attached extension sections, if any, are firmly anchored in the soil. The trailing end of the last extension (or the trailing end of the helical pier's shaft, if no extensions were used) protrudes above-ground, thus providing a tying point for above-ground structures. Depending on the weight of the above-ground structure, several helical piers may be arranged over a suitable area in order to provide the needed support. A variety of the above-ground structures may be erected over helical piers and extensions. Some examples of the above-ground structures are telecommunication towers, retaining walls, buildings, bridges, walkways and boat moorings.

The benefits of helical piers which pull the extensions into the soil as the piers spin have been recognized for a long time. The helical piers available on the market usually have a cutting tip formed by a slanted surface that extends over the cross-section of the shaft and forms a slanted cutting edge at the penetrating end of the shaft. Such helical piers tend to work well in soft soils, i.e. the soils that lack significant rock content, either loose or compact. When used in rocky soils, i.e. the soils with significant rock content, the prior art helical piers penetrate less well. At least in part this is believed to be due to the fact that the cutting edge and the adjoining cutting surface are not well-suited for spiraling through the high rock content in the soil. A helical pier should penetrate soil at the rate of about one pitch of the helical plate per shaft revolution so that the helical plate of the pier can spiral into the soil as it is rotated without significantly disturbing the surrounding soil. At least in part due to the hardness of the rocky soil, the prior art helical piers are at times unable to penetrate by a full helical pitch per revolution. This results in soil displacements around the helical plate as it seeks to spiral into the soil during each revolution, which slows the vertical travel of the helical pier during each revolution to less than the pitch of the helical plate, disturbs the surrounding soil and reduces its load-bearing capacity.

This slowdown of the vertical progress of the helical pier into the soil as it is rotated is believed to be caused at least in part by the inefficient configuration of the cutting edge/surface of conventional helical piers. Since helical piers are not reusable, that is, once anchored in the ground they remain there permanently, the penetrating ends of conventional helical piers are simply defined by the tapered surface and the cutting edge it forms. Tapered ends of this type are helpful for impact driving elongated posts and the like into the ground. They are ill-suited to form a hole in the ground for the shaft of the helical pier, because while the helical pier rotates and is forced deeper into the soil, its penetrating end must open the hole into which the shaft of the pier can extend. Elongated shafts with tapered ends can loosen the soil as they advance into it, but they have no way of effectively removing soil as it is being loosened from the vicinity of the penetrating tip. As a result, the forward progress of the rotating helical pier may be less than the pitch of the helical pier per revolution. When that occurs, the helical plate of the pier will disturb the surrounding soil, loosen its compactness, and compromise the stability with which the helical pier is left in the ground.

This situation could be remedied by forming the elongated shaft of helical piers with elongated, debris-removing flutes, as are common in conventional drills. However, this is not practical for use with helical piers for at least two reasons. First, providing the elongated shaft of the pier with flutes that extend over the length of the shaft would greatly weaken the shaft. Here, strength is one of its primary requirements because, once placed in the soil, the shaft must carry the above-ground structure that will be secured to it.

In addition, providing the helical pier shaft with flutes over its length would greatly increase its cost. Shafts for helical piers are relatively heavy, solid steel bars which exhibit the desired strength and are relatively inexpensive to produce. A simple tapered end for the shaft, as used on prior art helical piers, can be very inexpensively formed, for example, by sawing, milling, forging, molding and other well-known shaping processes. The cost of the shaft of a helical pier would multiply if it had to be separately machined to provide debris-removing flutes or passages over the length of the shaft.

Other prior art piers depend on a repetitive application of an impact force to drive the rotating pier deeper into the soil. Such piers require special tools that provide both torque and impact. Furthermore, the tip of these impact tools must be made of very hard material, to prevent damage to the tool tip caused by repetitive impacts against rocks in the soil.

Yet some other piers are made of strong pipes with a drill bit at the leading edge. During the drilling, drilling fluids are pumped through the pipe. The flow of drilling fluid rotates the drill bit at the end of the pipe. The drilling fluid on its return path washes the removed soil along the outside surface of the pipe back to the surface. Therefore, a complete auguring of the soil around the rotating drill is done, which significantly weakens the carrying capacity of the in-ground structure.

Thus, there exists a need for a reasonably priced helical pier capable of penetrating even rocky soil without disturbing the compactness of the surrounding soil so that the helical pier becomes firmly anchored in the soil and provides a high load-bearing anchor capable of supporting relatively heavy loads.

BRIEF SUMMARY OF THE INVENTION

The present invention provides a helical pier having a rock tip that is especially suitable for use in rocky soils, i.e. the soils with significant rock content, either loose, compact, weathered or hard. The helical pier of the present invention minimizes cost, insertion time and its environmental impact, while providing substantial load-bearing capability.

A helical pier constructed in accordance with the present invention generally has a long, solid shaft and a helical plate attached thereto. The shaft has a plurality of cutting edges at its penetrating end. Behind the penetrating end of the shaft, at least one helical plate extending over an arc of about 360° is firmly attached to the shaft, preferably by welding. The diameter of the helical plate is chosen to suit the soil and load conditions at a given installation site and is typically bigger than the diameter of the shaft. When rotated, the plate spirals into the soil to thereby advance the pier into the soil.

Extensions may be attached to the trailing end of the helical pier's shaft with a variety of suitable attachment adapters such as rectangular fit sockets, flanges or threaded attachments. As the helical pier rotates and penetrates the soil, the extension attached to the trailing end of the shaft is pulled deeper into the soil. The torque for rotating the helical pier can be provided by pneumatic, hydraulic, mechanical or electrical drives that are well known to persons skilled in the art.

Pursuant to the present invention, the penetrating end of the shaft has a plurality of, typically two, spaced-apart end surfaces which generally face in the penetrating direction of the helical pier. In one preferred embodiment of the invention, each of the two end surfaces occupies roughly one-half of the cross-section of the shaft. The end surfaces are angularly inclined with respect to each other and diverge from an intersection point where the two surfaces, and typically also the peripheral surface of the shaft, intersect. The two end surfaces extend from the intersection point to the opposite side of the shaft, so that a leading tip of the shaft is defined by the first end surface and the earlier mentioned opposite peripheral surface of the shaft.

The second end surface is formed by cutting a simple recess into the penetrating end of the shaft which extends from the first cutting edge surface to the second cutting surface. The recess is bounded by a resulting inner recess wall defined by the recess. The recess wall and the end surface that defines the penetrating tip of the pier form an elongated lateral cutting edge which extends from the penetrating tip to the intersection point. During rotation of the shaft, the cutting edge loosens soil rock as the helical pier is rotated. As a result, a helical pier fitted with a penetrating end configured in this manner has excellent penetrating capabilities, even in rocky soil and rock.

In use, the helical pier having a rock tip is rotated and its penetrating end is initially suitably pushed into the soil until a leading edge of the helical plate enters the soil. After a substantial portion of the helical plate, and especially after the entire plate, has fully penetrated into the soil rock, continued rotation of the helical pier causes the helical plate to spiral the helical pier into the ground. Rotation is discontinued when the helical pier has reached a desired depth and torque in the ground.

As the helical pier rotates, the penetrating tip scrapes, crushes and disturbs the soil/rock it contacts, while the earlier lateral cutting edge loosens the soil/rock over the rotating cross-section of the shaft. As rotation continues and soil/rock becomes loosened, loose soil/rock accumulates in the recess formed in the tip of the shaft between the two end surfaces. The second end surface of the shaft slants away from the penetrating end of the shaft; that is, it generally slants towards the trailing end of the shaft. Soil/rock loosened by the penetrating tip of the shaft and/or the lateral cutting edge enters the recess and as the amount of soil/rock in the recess increases, the upwardly slanted (toward the trailing end of the shaft) end surface of the shaft directs the soil/rock out of the recess. This guides loosened soil/rock from the recess towards the periphery of the hole formed by the shaft rotating in the soil/rock where the shaft, and primarily its exterior surfaces, compact some of the loosened soil/rock into the undisturbed soil/rock surrounding the rotating shaft. By giving the shaft of the helical pier a square or, preferably, a rectangular cross-section, the rotating shaft forms a hole in the soil/rock which has a larger cross-section than the cross-section of the shaft. Expelled soil/rock can then accumulate in the resulting void or empty space between the periphery of the rotating shaft and the annulas in the soil/rock surrounding the shaft.

Thus, the helical pier with a rock tip of the present invention, and in particular the configuration of its penetrating end, overcomes or at least greatly reduces one of the principal drawbacks of conventional rotary piers in that the pier of the present invention permits soil/rock loosened by the rotating shaft to be guided away from the vicinity of the penetrating end. As a result, the helical pier can better advance into the surrounding soil/rock at a rate equal to or potentially equal to one pitch of the helical plate per revolution of the helical pier, post rock penetration (hardness dependent). Importantly, this is attained by forming a recess in the penetrating end of the shaft defined by flat surfaces that are readily cut into the shaft by relatively inexpensive processes, such as, for example, sawing, milling, flame cutting, forging and the like.

Due to the low cost of forming the penetrating tip of a helical pier, the pier of the present invention can be widely used to support all types of structures at relatively low cost while providing an enhanced stability of the anchor in the soil/rock when compared to conventional helical piers.

DETAILED DESCRIPTION OF THE INVENTION

The helical pier of the present invention minimizes penetration time and improves the manner in which helical piers penetrate the ground, which reduces soil/rock disturbance and thereby enhances the load-bearing capacity of the resulting anchor. The details of an exemplary embodiment of the present invention are explained with reference to FIGS. 1-4. A helical pier having a shaft with rectangular cross-section is illustrated in the figures, but a square, triangular or other cross-section can also be used.

Figure 1:
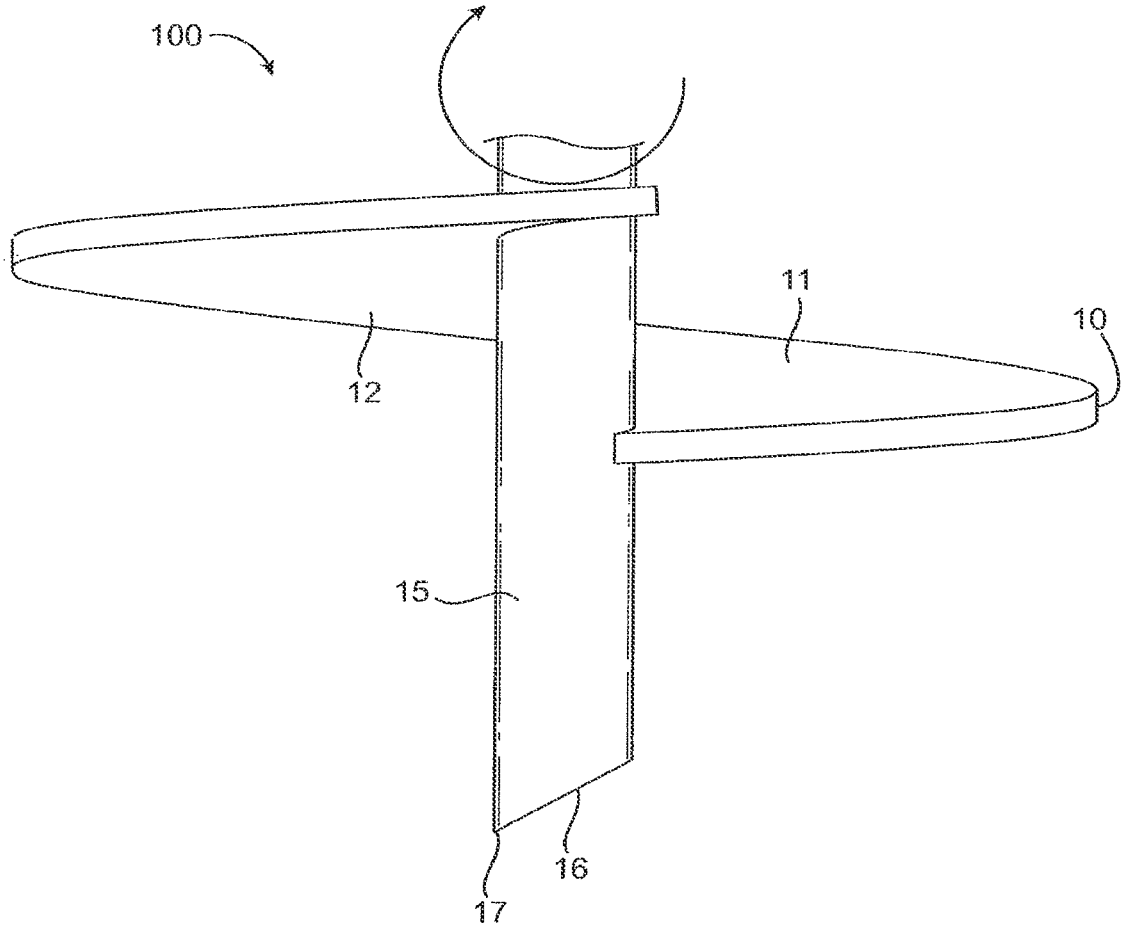
FIG. 1 shows a plan view of the prior art helical pier.

Prior art FIG. 1 shows a conventional helical pier 100 that performs adequately in soft soils. As helical pier 100 rotates, helical plate 10, which is welded onto shaft 15, spirals deeper into the soil. The penetrating end of the shaft has a slanted lead surface 16 in the form of an inclined plane extending over the entire cross-section of shaft 15. Slanted lead surface 16 intersects with a periphery 19 of the shaft and forms a penetrating tip 17 of the shaft.

If there are no rocks in the pier's path, helical plate 10 will drive helical pier 100 deeper into the soil at the rate of about one pitch of helical plate 10 per every revolution of the pier. However, the presence of rocks or rock in the soil can cause slower advancement of the prior art helical pier, resulting in a penetration of less than one helical pitch per revolution. This in turn loosens soil in the vicinity of the helical plate, which lowers the load-bearing capacity of the helical pier (causing augering spin out).

Figure 2:
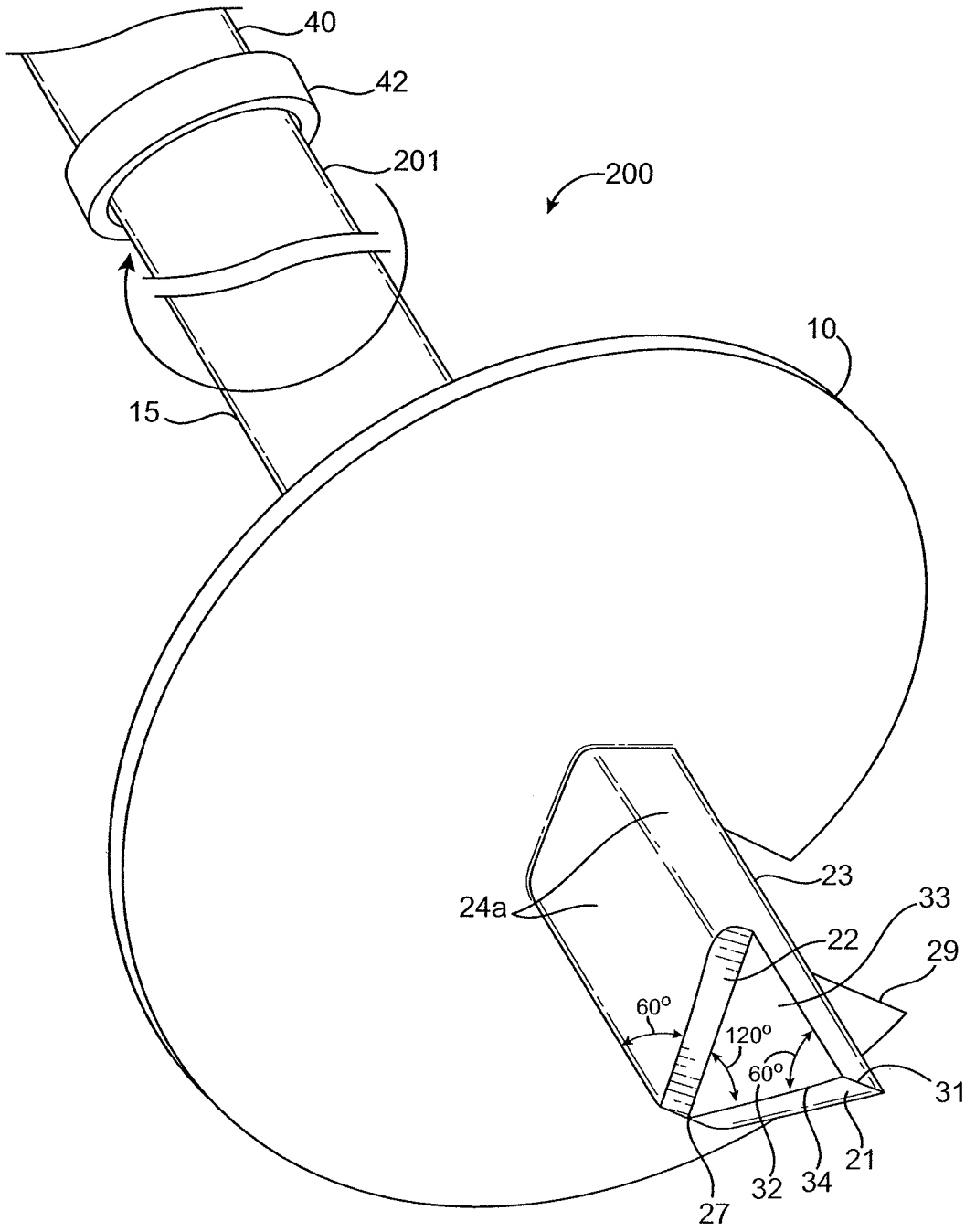
FIG. 2 shows a perspective view of one embodiment of the present invention.

Referring to FIG. 2, a helical pier 200 has a rotating shaft 15 and a helical plate 10 firmly attached on, e.g. welded to, the shaft. A torque suitably applied to a trailing end 201 of shaft 15 spins the shaft, which causes the helical plate to spiral into the soil, thereby pulling helical pier 200 deeper into the soil. Rotation of the shaft is stopped when the helical pier has reached the desired depth in the soil.

The penetrating end of rotating shaft 15 has two spaced-apart end surfaces which generally face in the direction in which the helical pier is advanced into the soil: a first, leading end surface 21 and a second, trailing end surface 22. In a preferred embodiment, each end surface occupies about one-half of the cross-section area of shaft 15. First end surface 21 is obliquely inclined relative to the axis of rotating shaft 15, preferably by an angle of about 60°. An intersection of first end surface 21 and a peripheral surface 24*a* of shaft 15 defines a penetrating tip or edge 31.

The trailing end surface 22 is formed by a recess 32 cut, e.g. sawed, into the penetrating end of shaft 15. As seen in an axial direction of the shaft from the penetrating end towards the trailing end, in one preferred embodiment of the invention the recess preferably extends over about one-half of the cross-section of the shaft, although its size can be increased or decreased if desired. The recess extends from the first end surface 21 in an axial direction towards the trailing end of the shaft. The recess further is bounded by a flat recess wall 33 that extends between the first and second end surfaces and defines a lateral cutting edge 34 where the recess wall and the first end surface 21 meet. The recess ends at the second end surface 22, which is angularly inclined relative to and diverges away from the first end surface 21. The second end surface 22 and the lateral cutting edge 34 meet at an intersection point 27 which is preferably at the periphery 24*a* of the shaft as shown in FIG. 2. As a result of this configuration, the second end surface 22 slopes away from penetrating edge 31 generally towards the trailing end of the shaft, as is also best seen in FIG. 2.

As mentioned, the intersection between recess wall 33 and the first end surface 21 defines the lateral cutting edge 34 of the helical pier which extends from penetrating edge or tip 31 to intersection point 27. In one presently preferred embodiment of the invention, the angle between the diverging first and second end surfaces 21, 22 is 120° as shown in FIG. 2.

In use, the longitudinal axis of helical pier 200 is aligned with the point on the ground where the helical pier is to be inserted, the pier is suitably rotated, and a force is applied to it to insert its penetrating tip 31 into the ground. After a leading edge 29 of helical pier 10 has entered the soil sufficiently, its continued rotation automatically spirals the plate and therewith the entire helical pier into the soil, with axial force continually applied.

As the penetrating end of the rotating shaft is advanced into the ground by the spiraling motion of helical plate 10, penetrating tip 31 of the shaft loosens the soil/rock beneath it as the shaft rotates. At the same time, lateral cutting edge 34 loosens soil/rock over the circular cross-section defined by the rotating shaft which accumulates in recess 32. As the shaft further penetrates into the soil/rock, loosened soil/rock builds up in the recess, which causes a pressure build-up in the soil/rock that guides the soil/rock along second end surface 22 away from intersection point 27 for discharge into the voids between the circular bore formed by the rotating shaft and the periphery of the shaft. The void between the circular hole formed by the rotating shaft and the cross-section of the shaft receives the loosened soil/rock expelled from the recess. At the same time, the ongoing rotating of the shaft compacts some of the expelled loose soil/rock into the undisturbed soil/rock surrounding the round hole. Rotating of the helical pier is stopped once the pier has reached the desired depth and torque in the soil/rock.

When the helical pier has to be inserted into the soil deeper than the length of shaft 15, one or more shaft extensions 40 can be secured to a trailing end 38 of the shaft with a suitable adapter 42. In such cases, rotation of the helical pier is stopped before its trailing end reaches the ground surface, the rotational drive is disconnected from the shaft, extension 40 is attached to the trailing end of the shaft, the drive is connected to the trailing end (not shown) of the extension, and rotation of the helical pier via the extension is continued until the pier has reached the desired depth. If necessary, additional extensions can be attached to the pier so that the pier can be inserted into the soil as deep as desired and/or required for a given installation.

After the helical pier has reached the desired depth, the rotational drive is disconnected from the shaft or the extension, and a structure to be supported by the helical pier can then be suitably attached to the end of the shaft or the extension projecting out of the ground.

Figure 3:
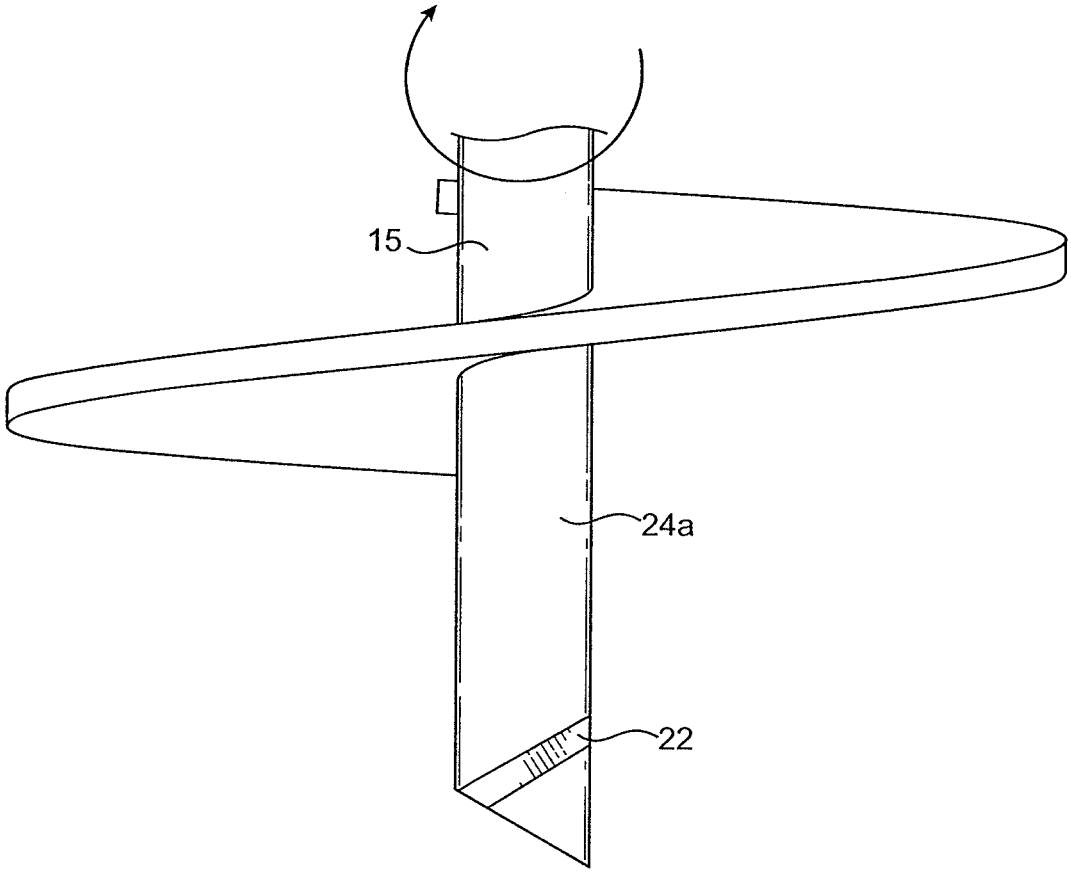
FIG. 3 shows a plan view of another embodiment of the present invention.
Figure 4:
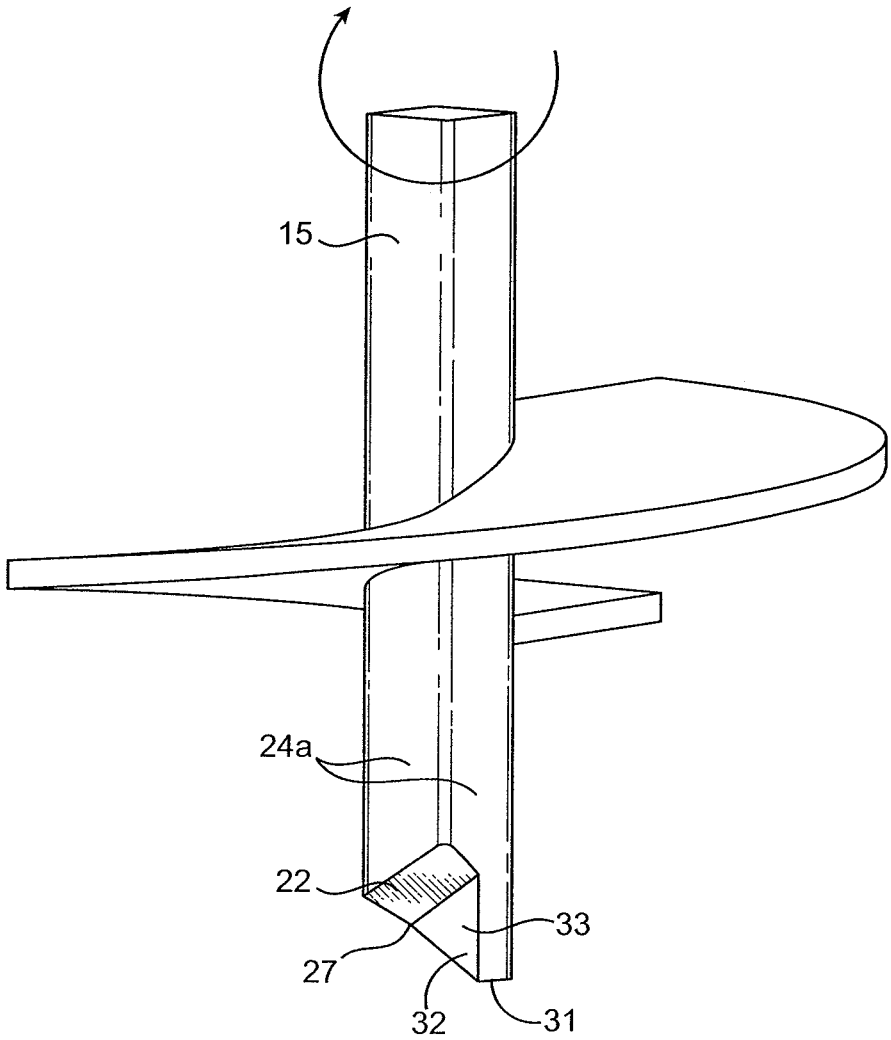
FIG. 4 shows a perspective view of the embodiment of FIG. 3.

In one embodiment of the invention, first end surface 21 and second end surface 22 form an angle of about 90° against lateral recess wall 33. In another embodiment, the angle between second end surface 22 and lateral wall 33 is an oblique angle as shown in FIGS. 3 and 4, which works well for some rocky soils. The oblique angle of the second end surface facilitates the discharge of the loose soil from the recess in the shaft into the voids between the rotating shaft and the surrounding hole in the soil as described above.

What is claimed is:

1. A helical pier rock tip for rotational insertion into soil/rock and anchoring a structure thereto, comprising:

an elongated shaft having a longitudinal axis, a penetrating end, a trailing end, and a peripheral surface between the penetrating end towards the trailing end, the penetrating end including a first end surface that is obliquely inclined relative to the axis and intersects the peripheral surface of the shaft to define a penetrating edge of the shaft, a recess formed in the shaft extending from the first end surface toward the trailing end of the shaft, forming a recess wall and terminating in a second end surface that is obliquely inclined relative to the first end surface and the longitudinal axis, the recess wall intersecting the first end surface to define a lateral cutting edge oriented transversely to the penetrating edge, the recess receiving soil/rock loosened by the penetrating edge and the cutting edge, the second end surface directing loosened soil/rock out of the recess when the helical pier is rotated into the soil/rock, and a helically-shaped plate arranged about the shaft proximate to and spaced apart from the recess which is configured to spiral into the soil/rock and thereby advance the shaft and the helical plate into the soil/rock when the helical pier is rotated into the soil/rock.

2. A helical pier rock tip according to claim 1 wherein each of the first and second end surfaces extends over approximately one-half of a shaft cross-section of the shaft.

3. A helical pier rock tip according to claim 1, wherein the first end surface and the second end surface each cover approximately one-half of a cross-section of the shaft.

4. A helical pier rock tip according to claim 1, further comprising an extension adapted to be attached to the trailing end of the shaft.

5. A helical pier rock tip according to claim 1, wherein the shaft is made of steel.

6. A helical pier rock tip according to claim 5, wherein the helical pier is galvanized.

7. A helical pier rock tip according to claim 1, wherein the first end surface is obliquely inclined relative to the axis of the shaft at an angle of about 60°.

8. A helical pier rock tip according to claim 1, wherein the second end surface is obliquely inclined relative to the first end surface at an angle of about 120°.

9. A helical pier rock tip to be rotated into soil/rock to anchor the pier therein, comprising:

an elongated, solid shaft having an axis, a periphery, a penetrating end terminating in a penetrating edge and a trailing end, a helically curved plate arranged about the shaft, spaced from the penetrating end and configured to helically spiral itself into the soil/rock when the helical pier is rotated, the penetrating end of the shaft defining first and second elongated, substantially flat end surfaces each of which is obliquely inclined in longitudinal directions of the first and second end surfaces relative to the axis and relative to the other end surface, a recess formed in the shaft extending from the first end surface to the second end surface and bounded by a substantially flat recess wall that extends substantially parallel to the shaft axis from the first end surface to the second end surface, the first end surface and the recess wall intersecting the first end surface over a length of the first end surface to define a lateral cutting edge, the lateral cutting edge extending generally from the penetrating edge towards the second end surface and ending at an intersection point where the first end surface, the lateral cutting edge and the recess wall converge, the second end surface generally extending from adjacent the intersection point away from the penetrating edge so that it guides loose soil/rock from the recess in the general direction of the second end surface out of the recess when the helical pier is rotated into the soil/rock.

10. A helical pier rock tip according to claim 9, wherein the first end surface and the second end surface are orthogonal to the recess wall.

11. A helical pier rock tip according to claim 9, wherein the first end surface is orthogonal to the recess wall, and the second end surface defines an obtuse angle with the recess wall.

12. A helical pier rock tip according to claim 9 wherein the first and second end surfaces and the recess wall are formed in the shaft by sawing.

13. A helical pier rock tip according to claim 9 wherein the first and second end surfaces and the recess wall are formed by one of sawing, milling, flame cutting, forging, molding, and addition of carbide tipping.

14. A helical pier rock tip according to claim 9, wherein the first end surface is obliquely inclined relative to the axis of the shaft at an angle of about 60°.

15. A helical pier rock tip according to claim 9, wherein the second end surface is obliquely inclined relative to the first end surface at an angle of about 120°.

* * * * *